US007551191B2

(12) United States Patent
Nishitani

(10) Patent No.: US 7,551,191 B2
(45) Date of Patent: Jun. 23, 2009

(54) PRINTING APPARATUS

(75) Inventor: Hitoshi Nishitani, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 170 days.

(21) Appl. No.: 11/670,515

(22) Filed: Feb. 2, 2007

(65) Prior Publication Data

US 2007/0195154 A1 Aug. 23, 2007

(30) Foreign Application Priority Data

Feb. 20, 2006 (JP) ..... 2006-042201

(51) Int. Cl.
*B41J 11/00* (2006.01)

(52) U.S. Cl. ..... 347/220

(58) Field of Classification Search ..... 347/197, 347/198, 218, 220, 222; 400/649, 651, 653
See application file for complete search history.

(56) References Cited

U.S. PATENT DOCUMENTS

2007/0071532 A1* 3/2007 Ho ..... 400/649

FOREIGN PATENT DOCUMENTS

| | | |
|---|---|---|
| JP | 06-015852 | 1/1994 |
| JP | 10-076716 | 3/1998 |

* cited by examiner

*Primary Examiner*—K. Feggins
(74) *Attorney, Agent, or Firm*—Fitzpatrick, Cella, Harper & Scinto

(57) ABSTRACT

A printing apparatus includes (a) a lever member which displaces at least one of a thermal head and a platen roller so that the head and the roller come close to each other or come away from each other, and (b) a driving unit which operates the lever member. The driving unit includes a rotary member having a rotary center shaft in a direction crossing a conveying direction of a recording medium and a roller shaft direction of the platen roller, and the rotary member is disposed in a conveying width region of the recording medium.

7 Claims, 12 Drawing Sheets

PRINTING APPARATUS

BACKGROUND OF THE INVENTION

1. Field of the Invention

The present invention relates to a printing apparatus which prints image information on a recording medium such as a recording sheet.

2. Description of the Related Art

Printing apparatuses such as a computer output apparatus and a digital video output apparatus can be classified into a thermal transfer type printing apparatus, an ink jet printing apparatus, a laser printing apparatus, or a wire dot printing apparatus in accordance with a recording system of the apparatus. Among them, a linear thermal transfer type printing apparatus, as an example of the thermal transfer type printing apparatus, conveys an ink sheet and a recording sheet in a sub-scanning direction while selectively driving a plurality of heat generators arranged in a main scanning direction. In consequence, dot lines are printed on the recording sheet.

In another type of printing apparatus such as an ink jet printing apparatus, there is only binary selection of whether or not to form dots. Therefore, while small dots are formed on the recording sheet, apparent resolution and gradation are to be obtained by a technique such as error diffusion. On the other hand, in the thermal transfer type printing apparatus, a thermal value can easily be changed so that one pixel can be controlled. Therefore, a lot of gradations can be taken with respect to one pixel. As a result, a smooth image having a high quality can be obtained as compared with another printing apparatus such as the ink jet printing apparatus.

FIGS. 6A and 6B are schematic diagrams showing a basic constitution of a conventional thermal transfer type printer. As shown in FIG. 6A, while an ink sheet 103 is brought into close contact with a recording sheet P by a thermal head 101 and a platen roller 102, the recording sheet P is conveyed downstream (in an arrow direction in the drawing) in a printing direction by a driving roller 104 and a driven roller 105.

At this time, the thermal head 101 is allowed to generate heat, thereby thermally transferring ink of the ink sheet 103 onto the recording sheet P to perform printing of a first color.

Subsequently, to perform the printing of the next color, at least one of the thermal head 101 and the platen roller 102 is moved so that they come away from each other. Next, the driving roller 104 and the driven roller 105 are rotated in a direction reverse to that of the first-color printing to return the recording sheet P to a printing start position, and the second-color printing is performed in the same manner as in the first-color printing. Subsequently, the above operation is repeated to perform printing of third and subsequent colors.

As a conventional driving mechanism which causes the thermal head and the platen roller to come close to each other or come away from each other, an example to adjust a position of the thermal head with respect to a platen is disclosed in Japanese Patent Application Laid-Open No. H06-015852.

Moreover, an example to adjust a position of the platen with respect to the thermal head is disclosed in Japanese Patent Application Laid-Open No. H10-076716.

FIGS. 7, 8A and 8B are diagrams showing a driving mechanism which causes the platen roller to come close to the thermal head or to come away from the same in the conventional thermal transfer type printer. FIG. 7 is a perspective view, FIG. 8A is a top plan view, and FIG. 8B is a side view. In FIGS. 7, 8A and 8B, a pair of left and right lever members 106*a*, 106*b* holds the platen roller 102. The members are capable of switching to a state in which the roller 102 comes close to the thermal head 101 or a state in which the roller comes away from the thermal head 101. A communication shaft 109 fixes a pair of left and right cams 107, 108 to the same shaft, and a gear 110 is fixed to one end of the communication shaft 109. A driving mechanism 111 rotates the gear 110. This driving mechanism 111 is constituted of a motor 111*a*, a worm gear 111*b*, a worm wheel 111*c* and the like.

Reference numerals 112*a*, 112*b* are rotary shafts of the lever members and the cams and worm wheel of the driving mechanism.

When the driving mechanism 111 rotates the cams 107, 108 at a predetermined angle via the gear 110 and the communication shaft 109, the lever members 106*a*, 106*b* cause the platen roller 102 to come close to the thermal head 101, or to come away from the same. FIG. 9 shows a state in which the cams 107, 108 rotate at the predetermined angle, so that the platen roller 102 comes away from the thermal head 101.

However, the conventional driving mechanism which causes the thermal head and the platen roller to come close to each other or to come away from each other as described above has to be provided with a pair of cams on opposite outer sides of a region where a recording medium is conveyed. Therefore, there has been a problem that miniaturization of the printing apparatus is restricted.

As seen from FIG. 8B, the ink sheet 103 is disposed in the vicinity of the thermal head 101. In this ink sheet 103, as shown in FIG. 10, an ink sheet portion 121 which comes into contact with the thermal head is sandwiched between ink sheet portions 103 and 120 which are to be fed out or taken up and which are wrapped in an outer package and formed into a cartridge. A constitution is general in which the cartridge is detachably attached in a longitudinal direction of the thermal head 101, that is, in an arrow B direction of FIG. 8A. Therefore, as viewed from a side surface in FIG. 8B, the cartridge cannot be laid out in a region on which the pair of cams 107, 108 (a region E in FIG. 8B) arranged on the opposite sides are superimposed.

Here, when the cams 107, 108 can be designed to be large, a large reduction ratio or a large stroke can be achieved. Therefore, the cams can be designed so as to be as large as possible.

Moreover, a diameter of a sheet roll of the rolled ink sheet 103 can be designed to be large. This is because the large roll diameter can lengthen a replacement cycle of the roll. There are advantages that a take-up radius is increased to set a take-up torque to be constant and that a tensile force of the ink sheet 103 to be fed out or taken up can relatively be reduced.

Furthermore, considering the miniaturization of the apparatus, it is important that components such as the cams 107, 108 and the ink sheet 103, which are a part of the driving mechanism for causing the thermal head 101 and the platen roller 102 to come close to each other or to come away from each other, should be arranged in the vicinity of the thermal head 101.

As described above, the cams and the ink sheet can be designed so as to be large in order to further improve a function of feeding out or taking up the ink sheet, a function of adjusting a distance between the platen and the thermal head and the like. Moreover, there is such a restriction that the components cannot be laid out in a region where they are superimposed on each other, although they should be arranged in the vicinity of the thermal head. This is a large design problem. For such a reason, there is a restriction on the layout of the cams and the ink sheet, and this is a problem in miniaturizing the printing apparatus.

SUMMARY OF THE INVENTION

The present invention solves this conventional problem, and an object thereof is to provide a printer which is miniaturized by relieving restrictions on a layout of cams and an ink sheet.

To achieve the above object, the present invention is a thermal transfer printing apparatus comprising: a lever member which displaces at least one of a thermal head and a platen roller so that the thermal head and the platen roller come close to each other or come away from each other; and driving unit for operating the lever member, the driving unit including a rotary member having a rotary center shaft in a direction crossing a conveying direction of a recording medium and a roller shaft direction of the platen roller, the rotary member being disposed in a conveying width region of the recording medium.

As described above, according to the printing apparatus of the present invention, as compared with a conventional technology, it is possible to reduce projection areas of constituting members for adjusting a distance between a platen and the thermal head at a time when the apparatus is viewed from a side surface direction which is an attaching/detaching direction of the ink sheet. Therefore, there is an effect of lightening the restrictions on the layout of the constituting members which can be designed to be large from a viewpoint of a function and which should be arranged in the vicinity of the thermal head, and the ink sheet.

Moreover, a constitution of the present invention may be a constitution including cams in the rotary member, or a constitution including worm gears for transmitting rotation forces to the cams.

The printing apparatus of the present invention may have a constitution in which a guide member to guide the recording medium is disposed between the driving unit and a conveyance path of the recording medium.

Further features of the present invention will become apparent from the following description of exemplary embodiments with reference to the attached drawings.

DESCRIPTION OF THE EMBODIMENTS

One example of an embodiment of a printing apparatus of the present invention will hereinafter be described. However, since a printing operation of the printing apparatus of the present invention is the same as that of a conventional example, description thereof is omitted. Only a mechanism for causing a thermal head and a platen roller to come close to each other or to come away from each other will hereinafter be described in detail as a characteristic of the present invention.

Figure 1:
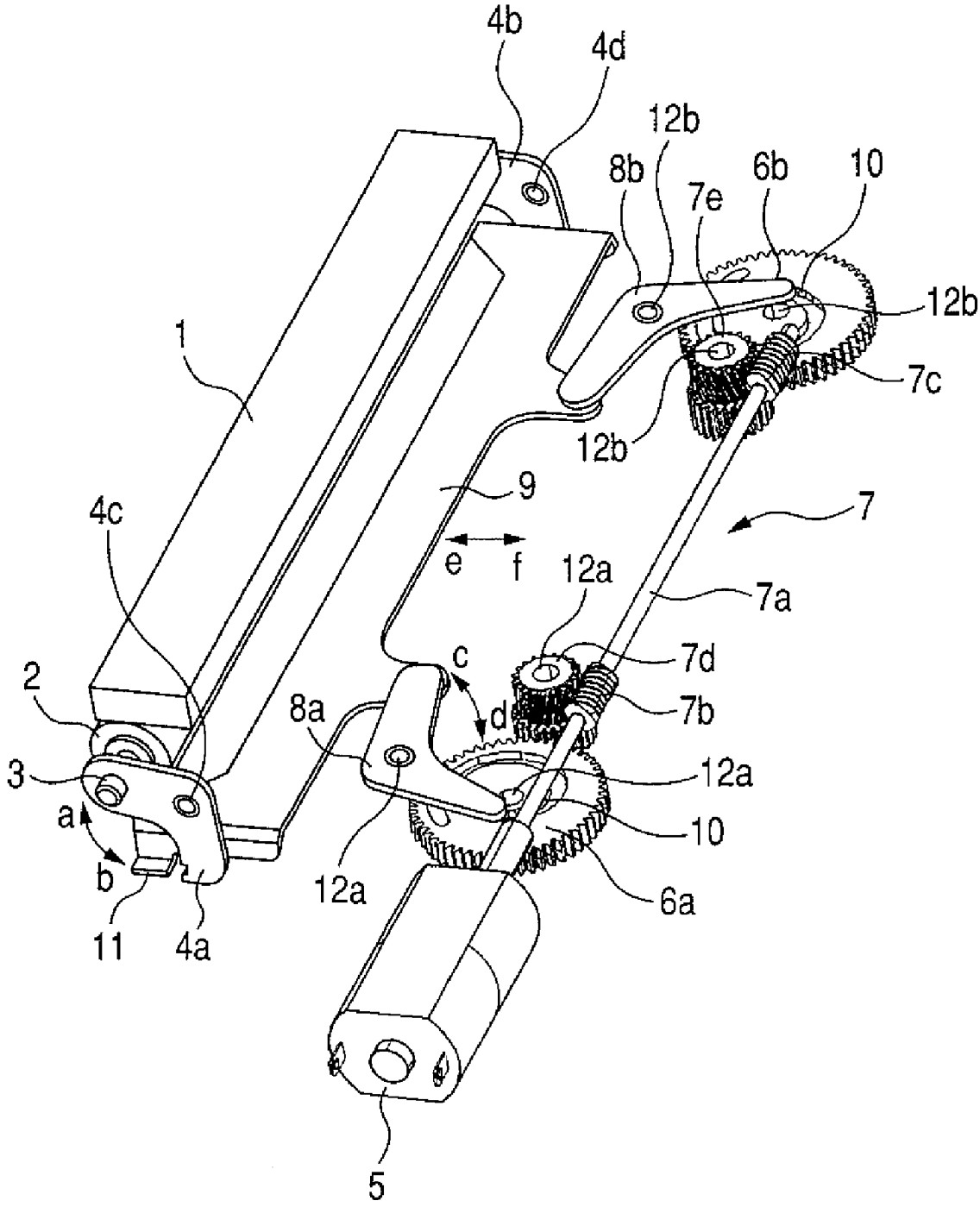
FIG. 1 is a perspective view showing a driving mechanism of a printing apparatus which is a first embodiment of the present invention.
Figure 2A:
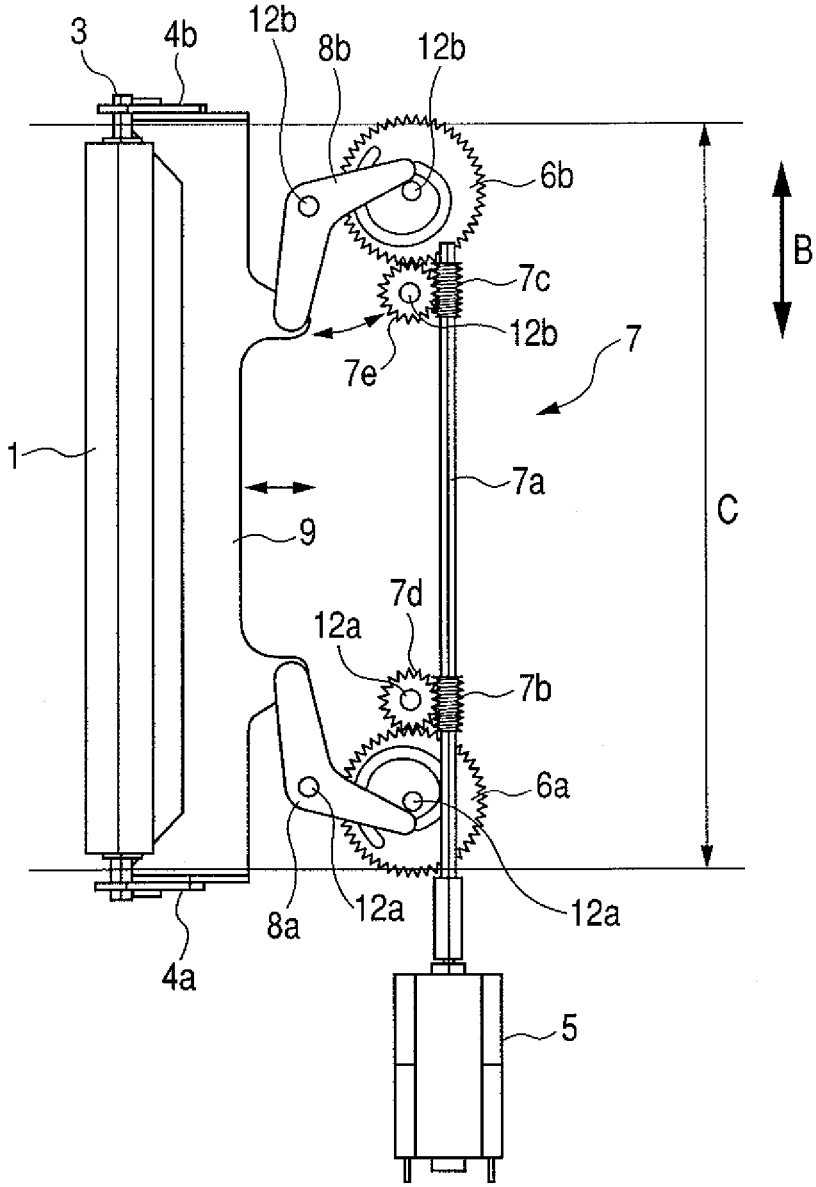
FIG. 2A is a top plan view showing that a thermal head and a platen roller of the first embodiment come close to each other.
Figure 2B:
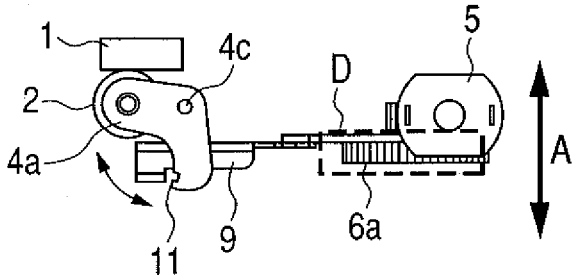
FIG. 2B is a side view showing that the thermal head and the platen roller of the first embodiment come close to each other.

FIGS. 1A, 1B and 2 are diagrams showing a mechanism for causing a thermal head 1 and a platen roller 2 to come close to each other or to come away from each other, FIG. 1 is a perspective view, FIG. 2A is a top plan view, and FIG. 2B is a side view.

The platen roller 2 is supported by a rotary shaft 3, and opposite ends of the rotary shaft 3 are supported by a pair of lever members 4*a*, 4*b* substantially having an L-shape, respectively. Moreover, in a case where driving unit described later rotates the lever members 4*a*, 4*b* in an arrow a-b direction centering on rotary center shafts 4*c*, 4*d*, respectively, the mechanism is switched to a state in which the platen roller 2 comes close to the thermal head 1 or a state in which the platen roller 2 comes away from the thermal head 1.

The driving unit has a motor 5 as a driving source, a pair of left and right cam gears 6*a*, 6*b* and a driving transmission mechanism 7 for transmitting a rotation force of the motor 5 to the cam gears 6*a*, 6*b*. The driving transmission mechanism 7 is constituted of a driving transmission shaft 7*a*, worm gears 7*b*, 7*c*, worm wheels 7*d*, 7*e* and the like. Furthermore, a driving unit such as the cam gears, the worm gears and brackets rotate centering on rotary center shafts 12*a*, 12*b*. For example, a pair of left and right substantially L-shaped brackets 8*a*, 8*b* are rotatable in an arrow c-d direction in the drawing. The driving unit further has a plate 9 which is connected to the brackets and which is slidable in an arrow e-f direction in the drawing.

The surfaces of the cam gears 6*a*, 6*b* are provided with spirally concave grooves 10, and one end of each of the brackets 8*a*, 8*b* is fitted into each concave groove 10. The other end of each of the brackets 8*a*, 8*b* is rotatably connected to the plate 9. Furthermore, from opposite side portions of the plate 9 in a longitudinal direction, engagement pieces 11 protrude which are to be engaged with end portions (the end portions on a side opposite to a side on which the rotary shaft 3 is supported) of the lever members 4*a*, 4*b*.

When the cam gears 6*a*, 6*b* rotate around the rotary center shafts 12*a*, 12*b* in a predetermined direction at a predetermined angle, the brackets 8*a*, 8*b* rotate in an arrow d direction in the drawing. With this rotation, the plate 9 slides in an arrow f direction, and the engagement pieces 11 move in the same direction. The lever members 4*a*, 4*b* then rotate in an arrow b direction, and the platen roller 2 moves in the same direction to come away from the thermal head 1.

Figure 3:
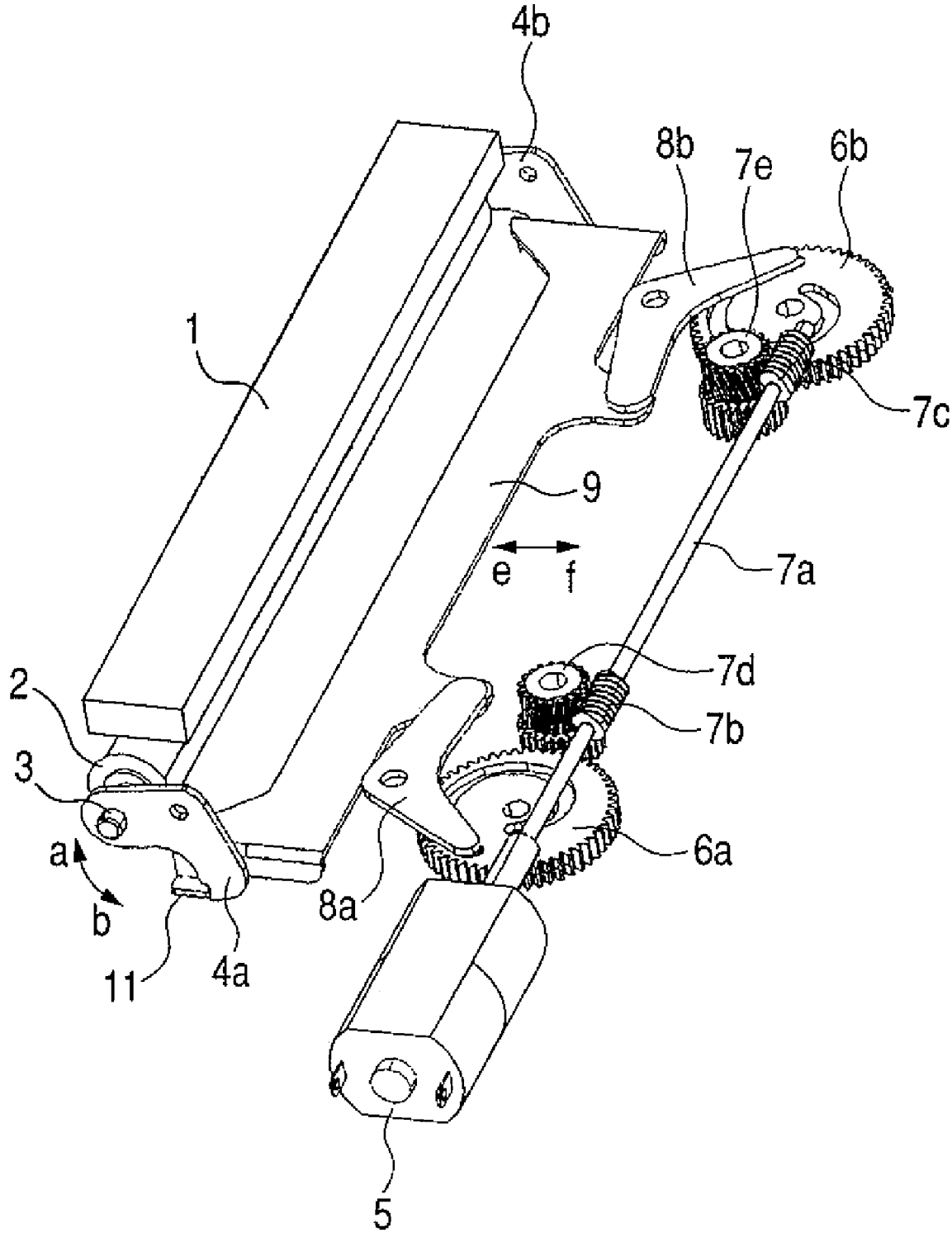
FIG. 3 is a perspective view showing that the thermal head and the platen roller of the first embodiment come away from each other.
Figure 4A:
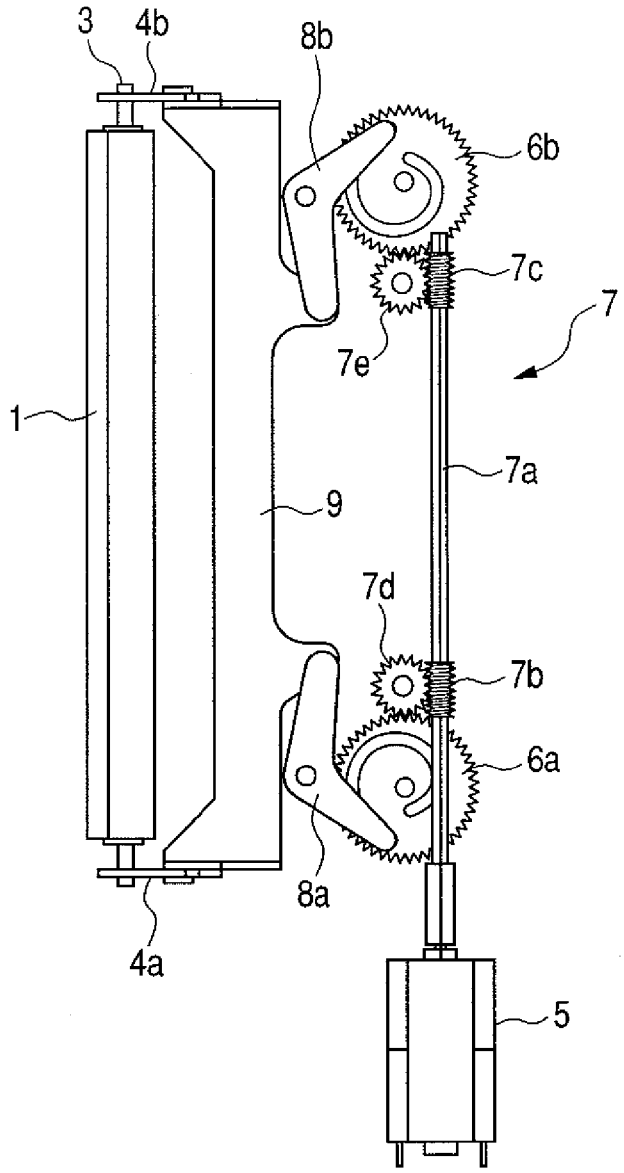
FIG. 4A is a top plan view showing that the thermal head and the platen roller of the first embodiment come away from each other.
Figure 4B:
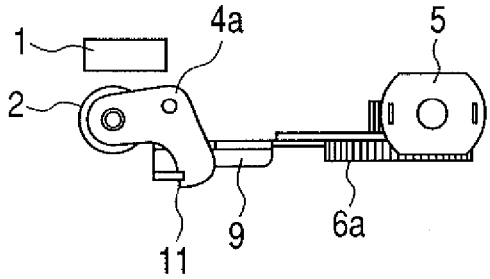
FIG. 4B is a side view showing that the thermal head and the platen roller of the first embodiment come away from each other.

FIGS. 3, 4A and 4B show a state in which the platen roller 2 comes away from the thermal head 1 as described above. FIG. 3 is a perspective view of the above state, FIG. 4A is a top plan view, and FIG. 4B is a side view. From these drawings, a behavior can be understood in which the cam gears 6*a*, 6*b* rotate at the predetermined angle to thereby rotate the lever members 4*a*, 4*b* in the arrow b direction in FIG. 1. As a result, the platen roller 2 comes away from the thermal head 1.

Figure 7:
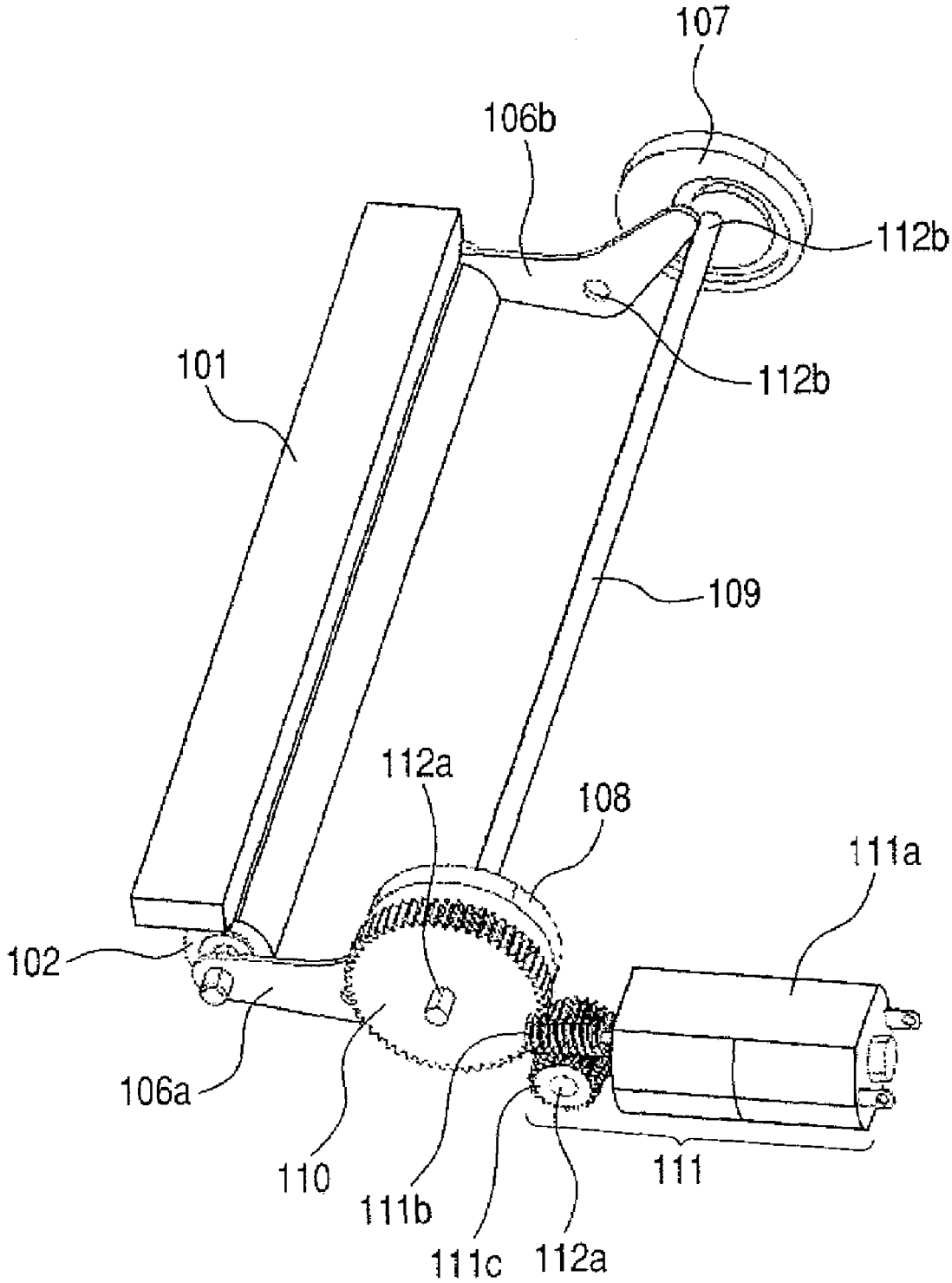
FIG. 7 is a perspective view showing one example of a driving mechanism disposed in a conventional printing apparatus.
Figure 8A:
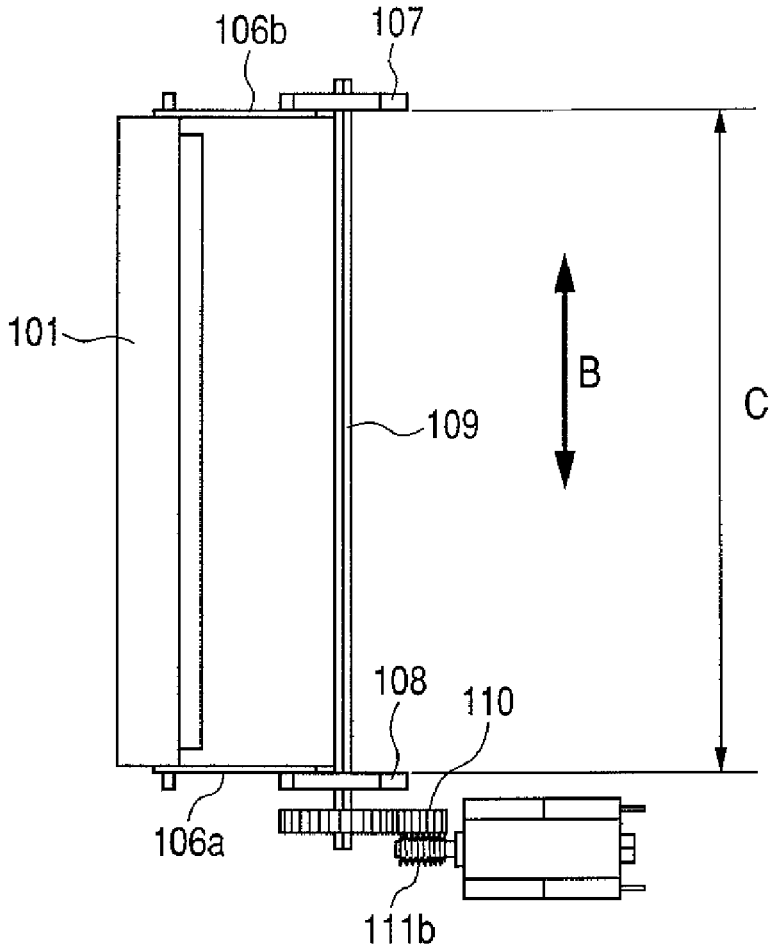
FIG. 8A is a top plan view showing that a conventional thermal head and platen roller come close to each other.

Here, the cam gears 6*a*, 6*b* constituting the above driving unit have the rotary center shafts 12*a*, 12*b* which are vertical to the surface of a recording medium to be conveyed. That is, the gears have the rotary center shafts parallel to a normal direction (an arrow A direction of FIG. 2B) of the surface of the recording medium to be conveyed. On the other hand, in a conventional example, cams 107, 108 corresponding to the cam gears 6*a*, 6*b* have rotary center shafts parallel to an arrow B direction in FIG. 2A (see 112*a*, 112*b* in FIG. 7). The cam gears 6*a*, 6*b* are arranged in a width-direction region (a range C shown in FIG. 2A) where the recording medium passes as viewed from the normal direction. On the other hand, in the conventional example, the cams 107, 108 corresponding to the cam gears 6*a*, 6*b* are arranged externally from a region corresponding to the above range C. See the range C of FIG. 8A.

Figure 8B:
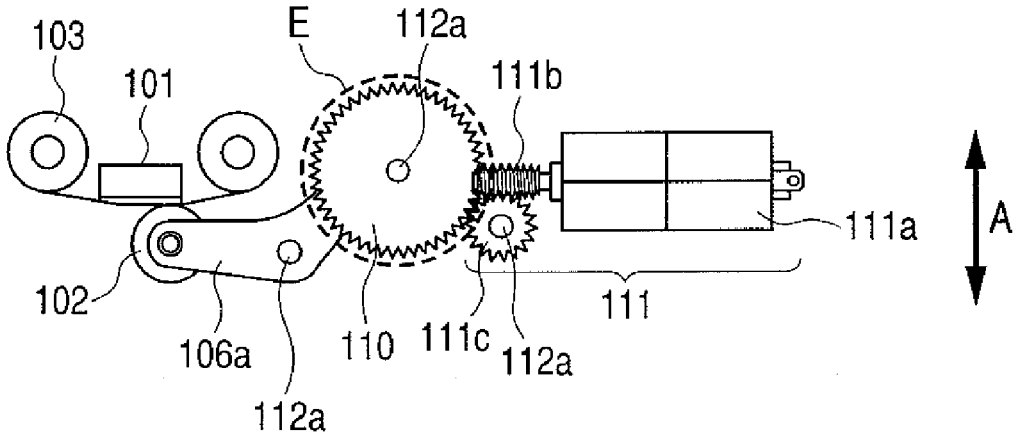
FIG. 8B is a side view showing that the conventional thermal head and platen roller come close to each other.
Figure 9:
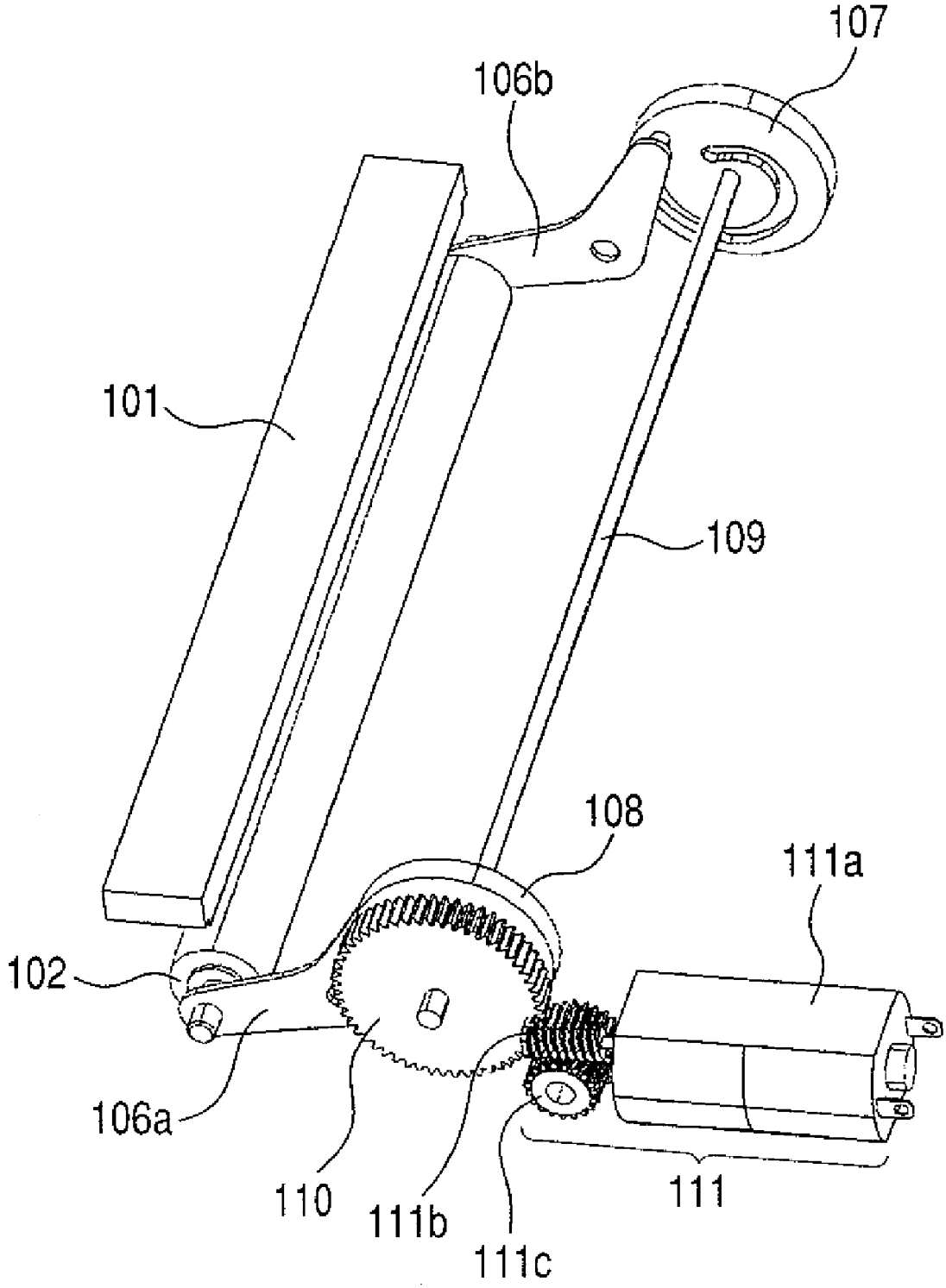
FIG. 9 is a perspective view showing that the conventional thermal head and platen roller come away from each other.
Figure 10:
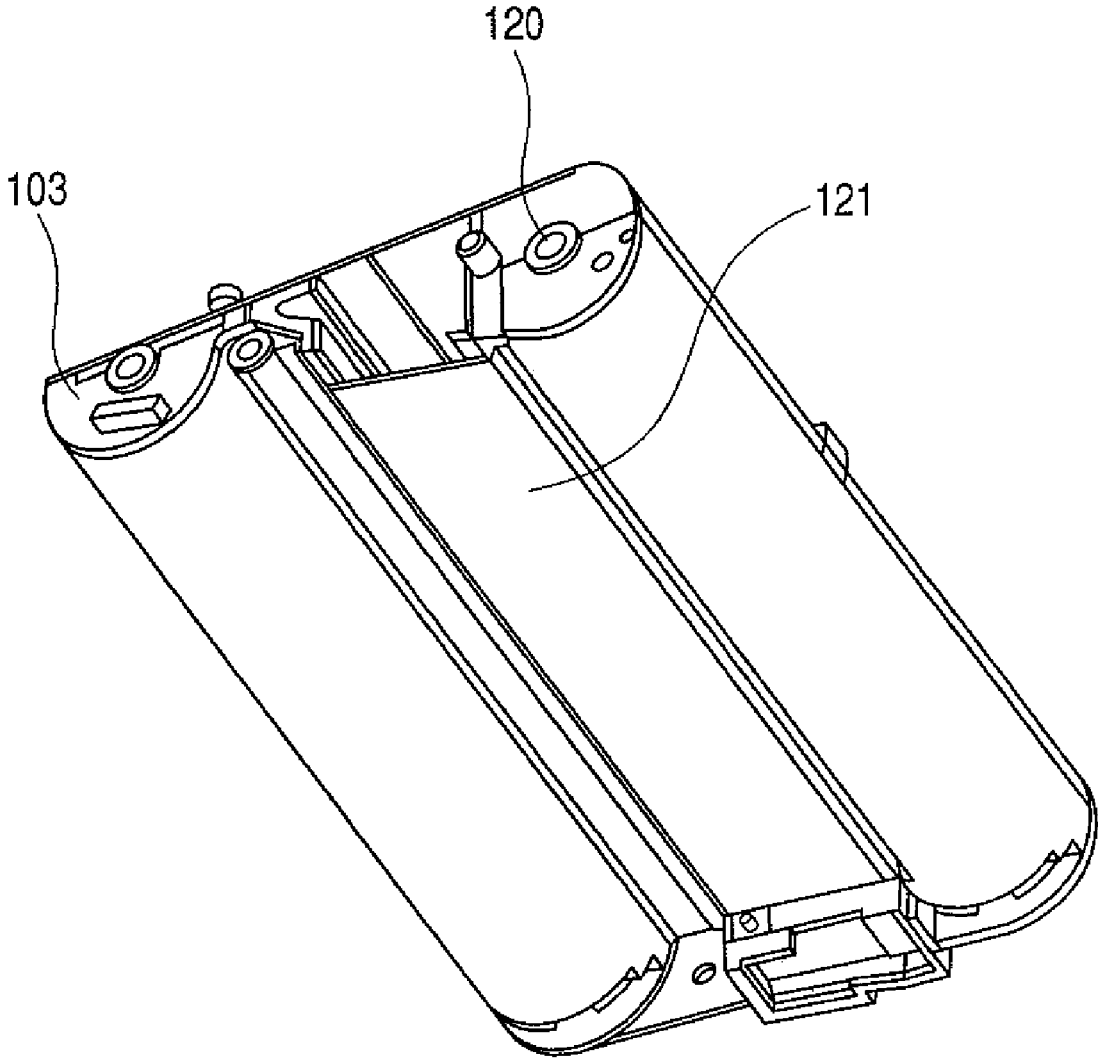
FIG. 10 is a perspective view of an ink sheet cartridge.

That is, projection areas (a range D shown in FIG. 2B) of the cam gears 6*a*, 6*b* viewed from a side surface direction (=an attaching/detaching direction of the ink sheet=the arrow B direction of FIG. 2A) are very small as compared with the conventional example (a range E shown in FIG. 8B).

When the cam gears 6*a*, 6*b* are laid out as described above, restrictions on the layout of the cam gears 6*a*, 6*b* are largely lightened, the gears being components which can be designed to be as large as possible and which should be arranged in the vicinity of the thermal head 1. Restrictions on the layout of the ink sheet are similarly largely lightened. This is a large design merit, and largely contributes to miniaturization of the printing apparatus.

In this case, it is most effective for achieving the object of the present invention to lay out the rotary center shafts of all rotary members except the worm gears 7*b*, 7*c* so that the shafts are vertical to the surface of the recording medium to be conveyed. That is, it is most effective for achieving the object of the present invention to lay out the rotary center shafts of all the rotary members except the worm gears 7*b*, 7*c* so that the shafts are parallel to a normal direction (an arrow A direction in FIG. 2B) of the surface of the recording medium.

However, the driving unit for moving at least one of the thermal head 1 and the platen roller 2 to cause them to come close to each other or to come away from each other is not limited to the above constitution with the proviso that a pair of left and right cams can have a mirror-image symmetric constitution in a case where the cam gears 6*a*, 6*b* of the present example or the corresponding cams are arranged.

Moreover, a constitution in which two worm gears 7*b*, 7*c* are coaxially supported is the simplest constitution. Especially in a case where a pair of worm gears progressing in opposite directions to each other and having an equal module, the equal number of threads and an equal travel angle are adopted, mutually canceling counteractive forces are generated and a good balance is achieved. (The module mentioned herein indicates a size of a gear tooth, and is a numeric value obtained by dividing a diameter of a tooth pitch circle by the number of the teeth. The larger a value of the module is, the larger the tooth becomes.)

Figure 11A:
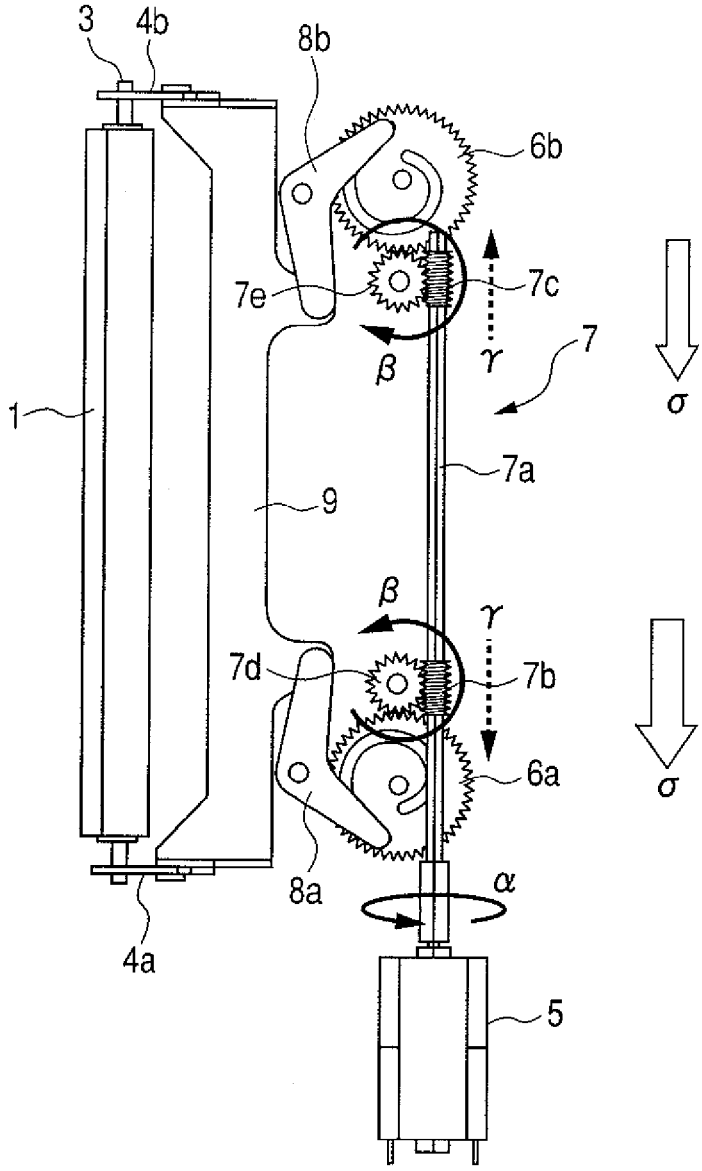
FIG. 11A is a top plan view showing a driving mechanism of a third embodiment of the present invention.
Figure 11B:
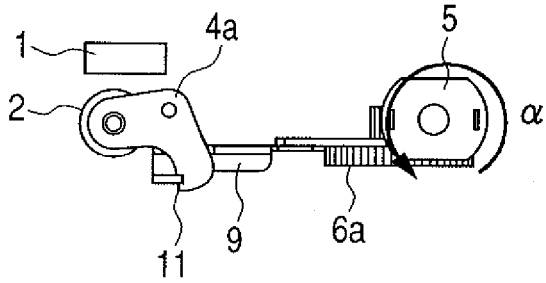
FIG. 11B is a side view showing the driving mechanism of the third embodiment of the present invention.

When the motor 5 rotates in a direction $\alpha$ shown in FIG. 11B, the rotary shaft 7*a* of the motor rotates in a direction $\alpha$ shown in FIG. 11A. The worm wheels 7*d*, 7*e* rotate in a direction $\beta$ shown in FIG. 11A. Travel directions of worms (twist directions of the worm wheels) are counter directions. If a pair of worms has a mirror-image symmetric shape, they rotate at an equal speed in the direction $\beta$. Since a counteraction in this rotating direction $\beta$ acts on each worm wheel in a direction $\gamma$, forces of the motor shaft 7*a* cancel each other. As a result, the forces of the motor shaft are well balanced.

If the worms do not have the mirror-image symmetric shape and the counteractive force having the rotating direction of each worm is applied in a direction $\sigma$ shown in FIG. 11A, a sum of two forces having the same direction is applied to the rotary shaft of the motor. As a result, a thrust stop place of the motor shaft receives a total of the counteractive forces, and deterioration of durability of the motor might be caused.

Figure 12:
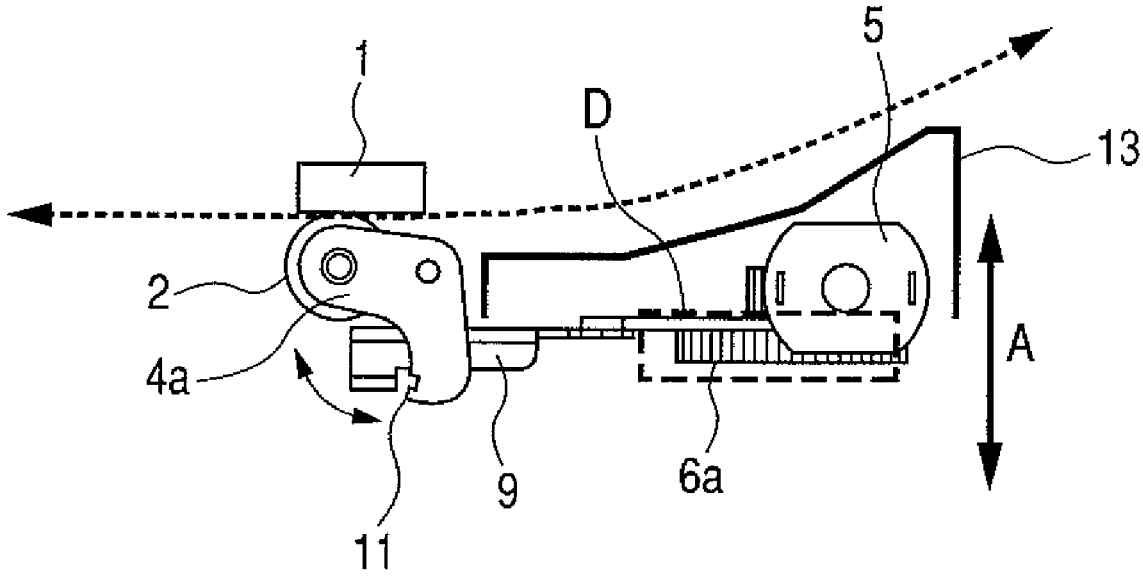
FIG. 12 is a sectional view of a recording medium guide member which covers a driving mechanism of the present invention.

Moreover, in a constitution shown in FIG. 12 in which the driving unit is covered with a guide member to guide the recording medium to be conveyed, a space of the printing apparatus is further saved.

The embodiment of the printing apparatus of the present invention has been described above in accordance with an example of a constitution in which the thermal head is fixed and the platen roller moves in such a direction as to come close to the head or to come away from the head. However, there is not any special restriction on a fixed side and a movable side as long as at least one of the thermal head and the platen roller can move so that they come close to each other or come away from each other. A driving mechanism may be connected to a thermal head side.

Figure 5:
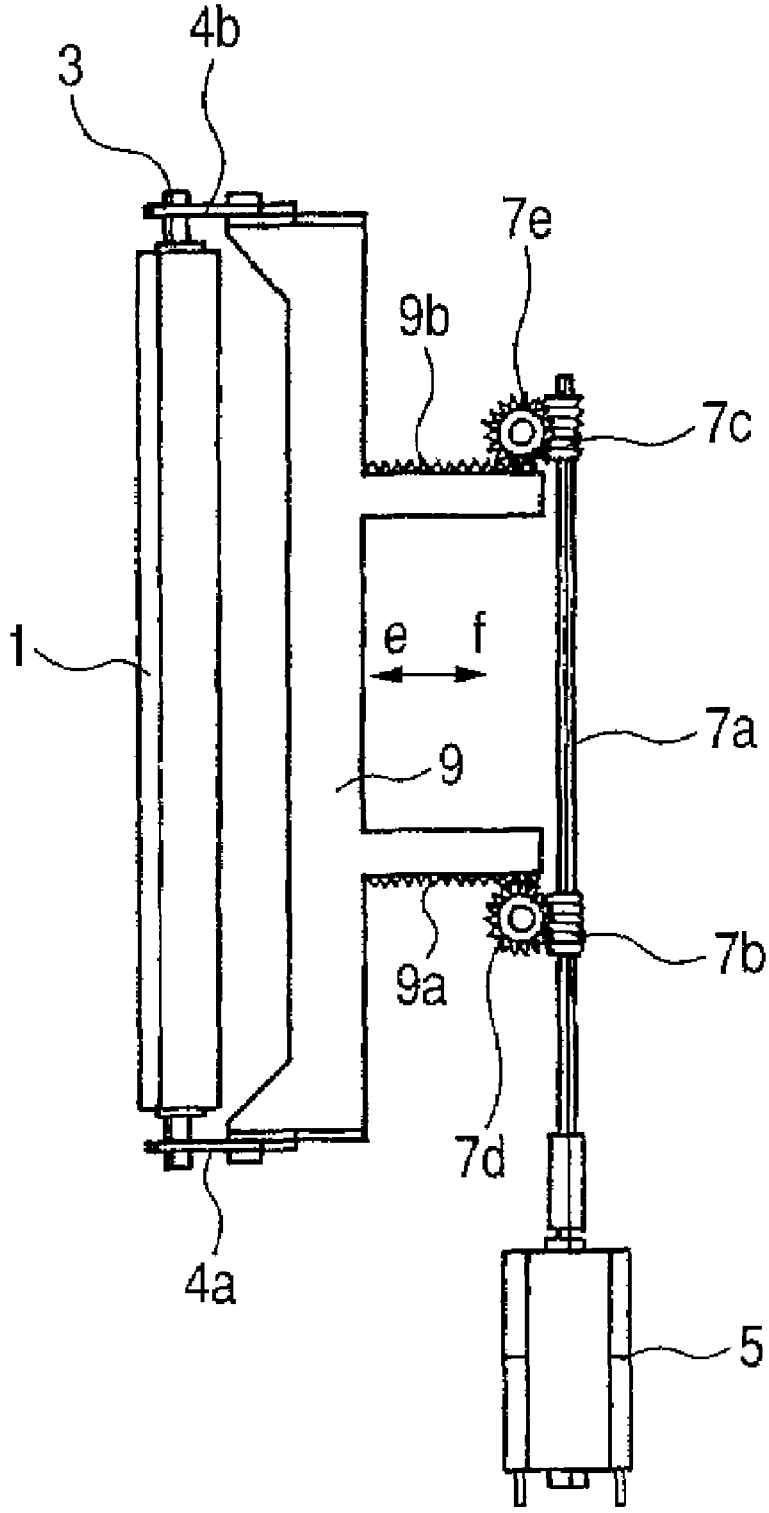
FIG. 5 is a top plan view showing a driving mechanism of a printing apparatus which is a second embodiment of the present invention.
Figure 6A:
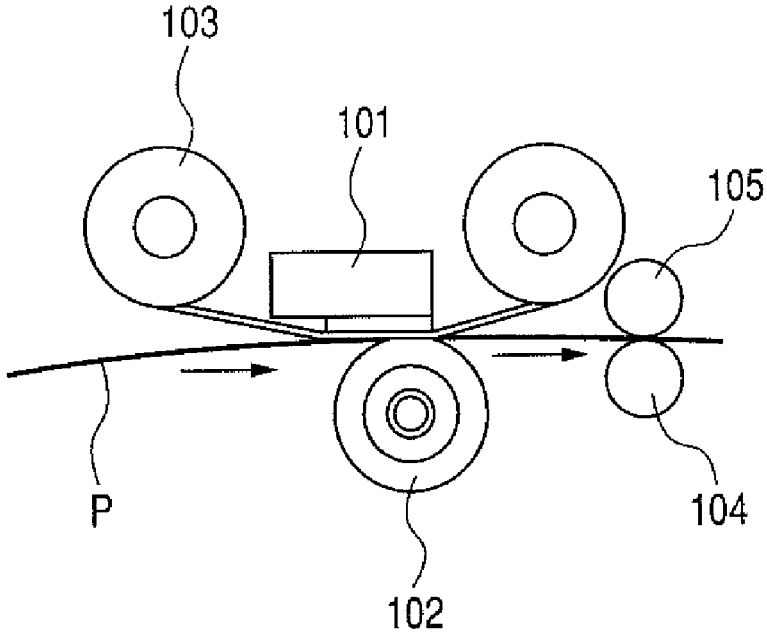
FIG. 6A is a schematic diagram showing that a recording sheet is conveyed by a constitution of a conventional thermal transfer type printer.
Figure 6B:
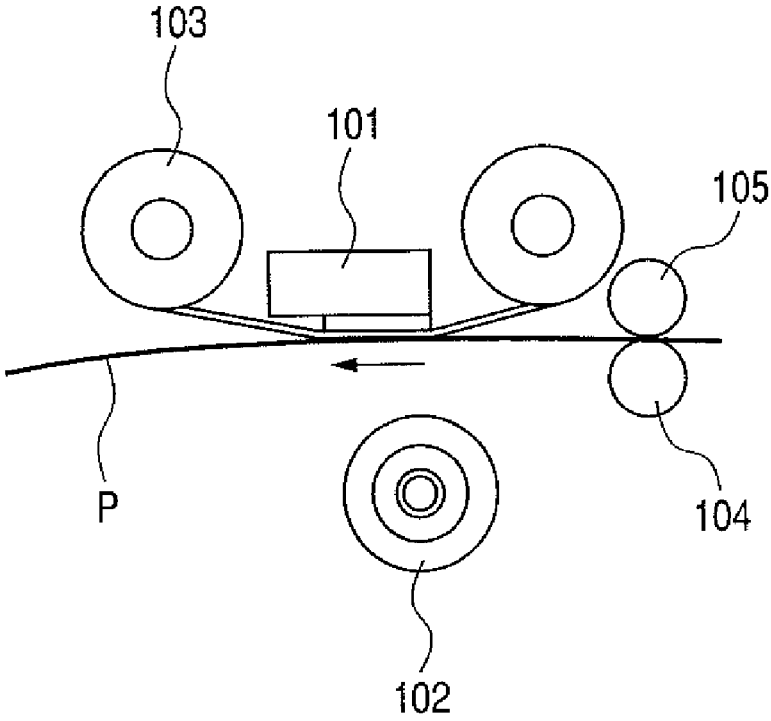
FIG. 6B is a schematic diagram showing that the recording sheet is inversely conveyed by the constitution of the conventional thermal transfer type printer.

FIG. 5 shows another constitution example for moving the platen roller as described above. It is to be noted that the same constitution as the above-described constitution is denoted with the same reference numerals in FIG. 5, and description thereof is omitted. In the constitution shown in FIG. 5, a plate 9 is provided with pinion gears 9*a*, 9*b* which engage with worm wheels 7*d*, 7*e*. According to such a constitution, the plate 9 is slid to reciprocate in an arrow e-f direction so that lever members 4*a*, 4*b* can be rotated in the same manner as described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-042201, filed Feb. 20, 2006, which is hereby incorporated by reference in its entirety.

What is claimed is:

1. A thermal transfer printing apparatus comprising:

a lever member which displaces at least one of a thermal head and a platen roller so that the thermal head and the platen roller come close to each other or come away from each other; and a driving unit for operating the lever member, wherein the driving unit includes a rotary member having a rotary center shaft in a direction crossing a conveying direction of a recording medium and a roller shaft direction of the platen roller, wherein the rotary member is disposed in a conveying width region of the recording medium, wherein the rotary member includes cams which rotate the lever member, wherein the driving unit includes worm gears which transmit rotation forces to the cams, and wherein rotary center shafts of all rotary members constituting the driving unit except rotary center shafts of the worm gears are arranged in a direction crossing a conveying direction of the recording medium and a roller shaft direction of the platen roller, and are arranged in a conveying width region of the recording medium.

2. The printing apparatus according to claim 1, wherein the rotary member includes a pair of cams having a mirror-image symmetric shape.

3. The printing apparatus according to claim 1, wherein the driving unit has two worm gears, and the worm gears have a common rotary center shaft.

4. The printing apparatus according to claim 3, wherein the worm gears have an equal module, the equal number of threads and an equal travel angle, and progress in opposite directions to each other.

5. The printing apparatus according to claim 3, wherein the rotary center shaft common to the worm gears is parallel to the roller shaft direction of the platen roller.

6. The printing apparatus according to claim 1, wherein a guide member to guide the recording medium to be conveyed along a conveyance path is disposed between the driving unit and the conveyance path of the recording medium.

7. A driving mechanism comprising:

a lever member which displaces at least one of a thermal head and a platen roller so that the thermal head and the platen roller come close to each other or come away from each other; and a driving unit for operating the lever member, wherein the driving unit includes a rotary member having a rotary center shaft in a direction crossing a conveying direction of a recording medium and a roller shaft direction of the platen roller, wherein the rotary member is disposed in a conveying width region of the recording medium, wherein the rotary member includes cams which rotate the lever member, wherein the driving unit includes worm gears which transmit rotation forces to the cams, and wherein rotary center shafts of all rotary members constituting the driving unit except rotary center shafts of the worm gears are arranged in a direction crossing a conveying direction of the recording medium and a roller shaft direction of the platen roller, and are arranged in a conveying width region of the recording medium.

* * * * *